United States Patent [19]

Cornelius, deceased et al.

[11] 4,301,971

[45] Nov. 24, 1981

[54] ELECTRICALLY-DRIVEN SPRAY GUN

[75] Inventors: Richard T. Cornelius, deceased, late of Minnetonka, Minn.; by Richard G. Lareau, executor, St. Paul, Minn.

[73] Assignee: Cornelius Engineering Center, Inc., Golden Valley, Minn.

[21] Appl. No.: 69,047

[22] Filed: Aug. 23, 1979

[51] Int. Cl.[3] ..... B05B 9/043

[52] U.S. Cl. ..... 239/351; 222/401; 239/355; 239/362; 239/373; 417/550; 417/569

[58] Field of Search ..... 239/373, 351, 355, 361, 239/362, 363, 365, 371, 332, 333; 222/401, 373; 417/550, 569, 570

[56] References Cited

U.S. PATENT DOCUMENTS

| | | | |
|---|---|---|---|
| 181,295 | 8/1876 | Weimer | 417/570 |
| 1,466,974 | 9/1923 | Todd | 417/550 |
| 1,661,239 | 3/1928 | Stephan | 239/373 |
| 2,296,883 | 9/1942 | Trask | 417/550 |
| 2,613,995 | 10/1952 | Reinhold | 239/351 |
| 2,629,539 | 2/1953 | Drewes, Jr. | 239/351 |
| 2,880,940 | 4/1959 | Briggs | 239/373 |
| 3,379,373 | 4/1968 | Roberts | 239/351 X |
| 3,465,469 | 9/1969 | Winter et al. | 239/351 X |
| 3,961,868 | 6/1976 | Droege, Sr. et al. | 417/550 |

FOREIGN PATENT DOCUMENTS

| | | | |
|---|---|---|---|
| 1453528 | 2/1969 | Fed. Rep. of Germany | 417/569 |
| 1067993 | 6/1954 | France | 239/355 |

*Primary Examiner*—Johnny D. Cherry

*Attorney, Agent, or Firm*—Hill, Van Santen, Steadman, Chiara & Simpson

[57] ABSTRACT

A spray gun for spraying of liquids utilizing compressed air includes a molded casing which contains within a sealed pressurized portion thereof, an electric motor and an air compressor driven by it. A manual trigger sequentially controls an electric switch for the motor and a needle valve for the discharge nozzle such that the motor and compressor are started before liquid is admitted to the nozzle, and are operated after liquid flow to the nozzle has been terminated. A diaphragm-type inlet check valve communicates with a pressure chamber of variable size forming a part of the air compressor, a second diaphragm providing both the movable wall of the pressure chamber as well as the movable element of an outlet check valve built therein which conducts pressurized air into the pressurized portion of the casing, passing across the motor enroute to the nozzle.

13 Claims, 6 Drawing Figures

FIG. 1
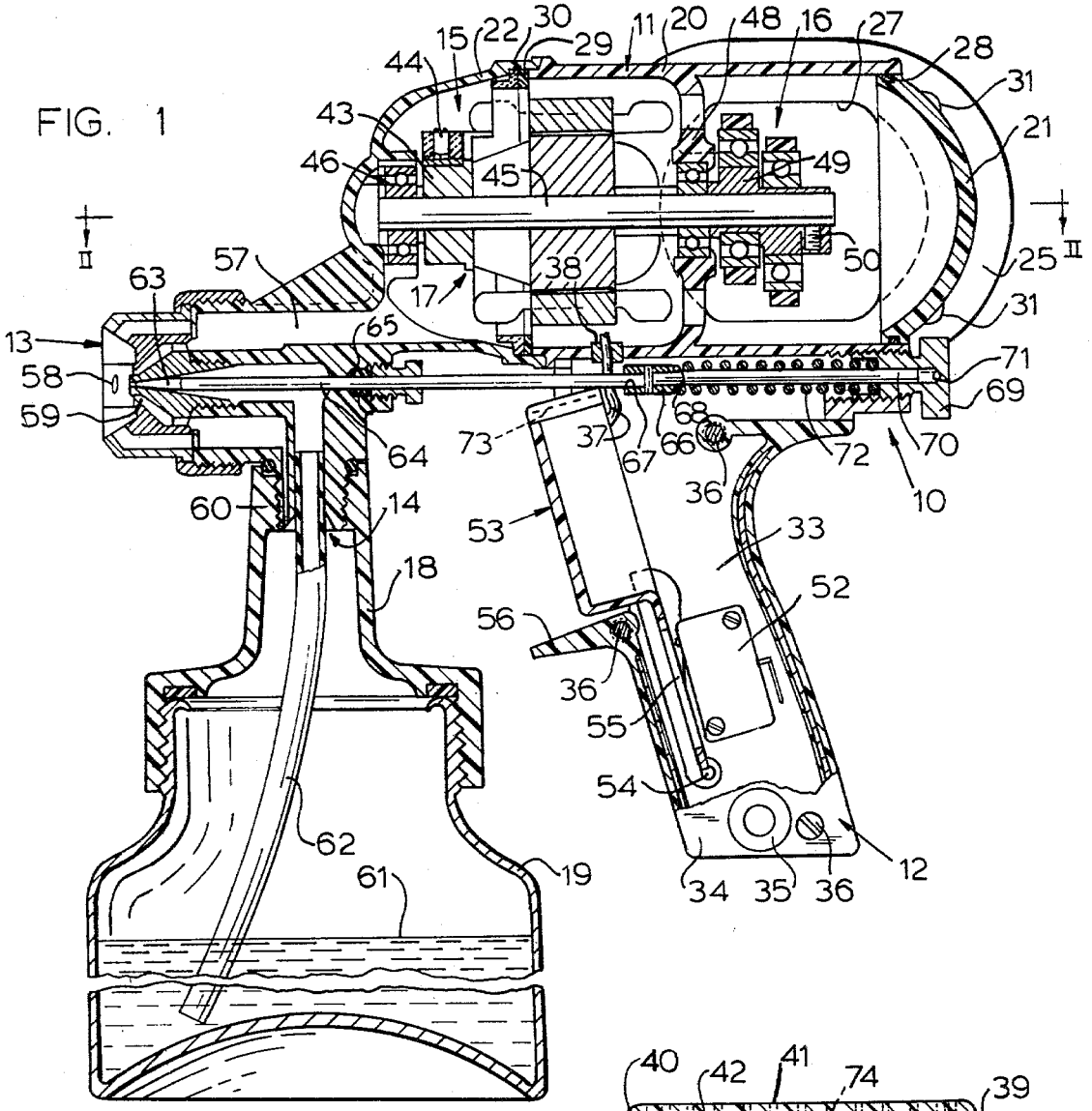
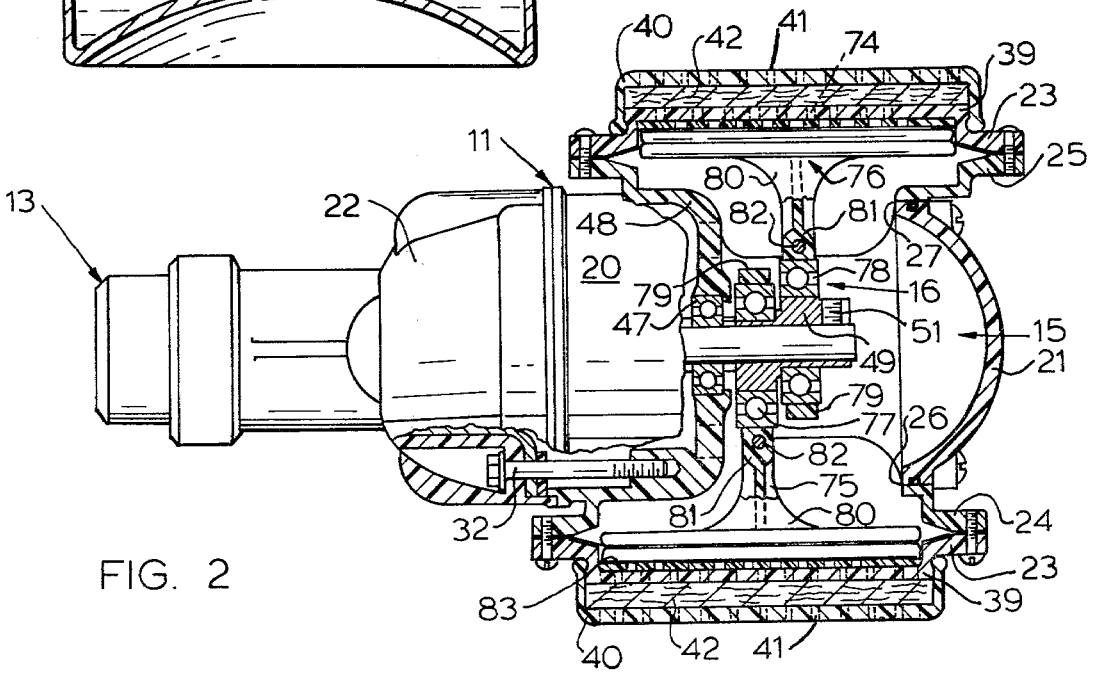
FIG. 2

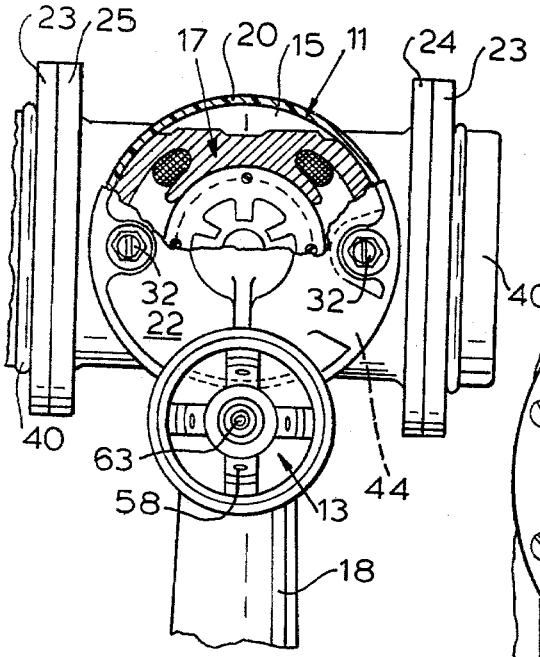
FIG. 3
FIG. 4
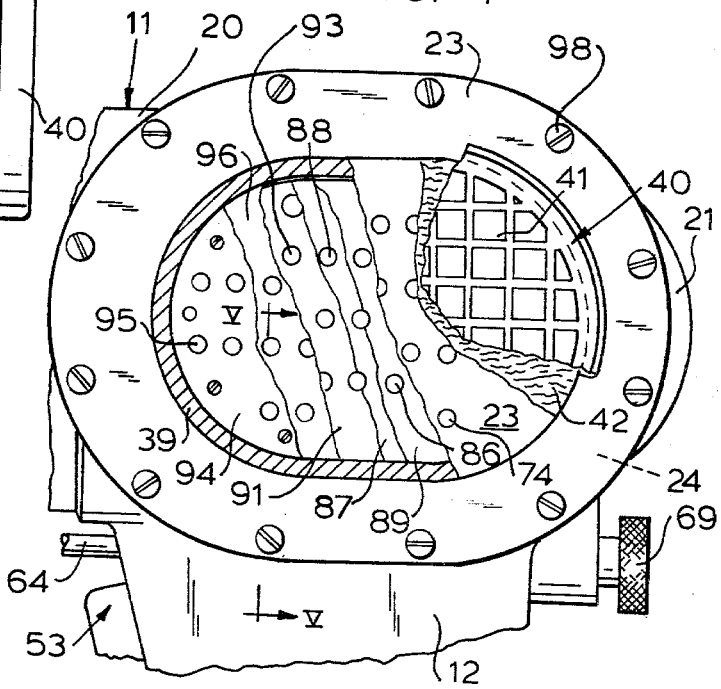
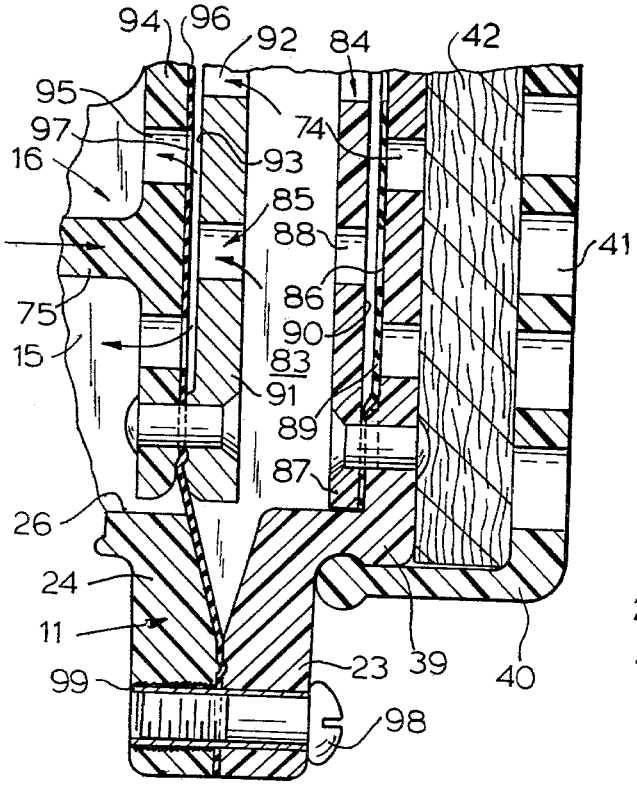
FIG. 5
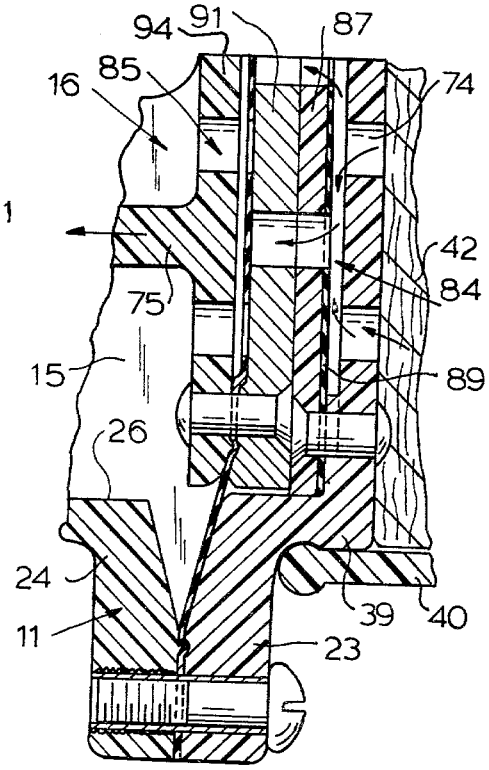
FIG. 6

ELECTRICALLY-DRIVEN SPRAY GUN

BACKGROUND OF THE INVENTION

1. Field of the Invention:

This invention pertains to spray guns which utilize compressed air in the spraying of liquids.

2. Prior Art:

Spray guns for spraying liquids using compressed air normally are connected to a hose leading to a remote compressor which typically is electrically powered. Such an installation is in its entirety rather heavy, bulky and expensive.

SUMMARY OF THE INVENTION

The present invention is directed to a spray gun for spraying liquids utilizing compressed air at a relatively low pressure, there being an electric motor and an air compressor embodied within the gun itself so that only an electrical cord leads to the spray gun assembly. Further, the motor and compressor are disposed within a pressure-sealed portion of the spray gun's casing so that the air passing through the compressor also passes across the motor to cool its, the air discharged by the gun being thereby heated slightly by both being compressed and by passing across the motor. In the disclosed embodiment, the compressor includes a pair of mechanically counterbalanced stages connected in fluid parallel with each other, and each utilizes an apertured diaphragm through which apertures the air that has been compressed passes. The construction of the spray gun is such that a major portion of the components can be formed of molded plastic.

Accordingly, it is an object of the present invention to provide a spray gun for spraying of liquids utilizing compressed air wherein the gun is relatively light in weight, is inexpensive to construct, and where vibration is minimized.

Another object of the invention is to utilize air that will pass through the spraying nozzle as a cooling medium for the electric motor.

A still further object of the present invention is to provide a diaphragm-type compressor within the spray gun wherein the air passes through apertures in the diaphragm.

Many other features of the present invention will become manifest to those versed in the art upon making reference to the detailed description and the accompanying sheets of drawings in which a preferred structural embodiment incorporating the principles of the present invention is shown by way of illustrative example.

ON THE DRAWINGS

FIG. 1 is a vertical cross-sectional view of a spray gun constructed in accordance with the principles of the present invention;

FIG. 2 is a top view thereof partly shown in cross-section taken along the line II—II;

FIG. 3 is a front view of the spray gun, partially broken away and shown in cross section, of the gun as viewed from the left in FIG. 1;

FIG. 4 is an enlarged fragmentary side view of the gun, partly broken away in cross section the same being a side view of FIG. 3 as viewed from the right; and FIGS. 5 and 6 are enlarged fragmentary cross-sectional views taken along line V—V of FIG. 4, FIG. 5 representing the beginning of a compression stroke, and FIG. 6 representing the beginning of a return stroke.

AS SHOWN ON THE DRAWINGS

The principles of the present invention are particularly useful when embodied in a spray gun such as shown in FIG. 1, generally indicated by the numeral 10. The gun 10 includes a molded casing 11 having a handle 12 at one end thereof, a nozzle assembly 13 at the other end, and a liquid intake port 14. The casing 11 includes a pressurizable portion 15 which contains an air compressor 16 driven by an electric motor 17. The casing 11 may include an adaptor such as 18 by which a liquid container 19 is secured thereto, the container 19 being conventional.

The casing 11 includes a tubular body portion 20, a rear end cap 21, a front end cap 22, and a pair of apertured heads 23, 23 that are respectively secured against a pair of flanges 24,25 which are integral with the casing and which surround respectively a pair of lateral side openings 26,27 in the tubular portion 20. The tubular portion 20 along with the end caps 21,22 jointly define the pressurizable portion 15 and to that end, there is an O-ring seal 28 disposed on the outer periphery of the rear end cap 21 that seals against an inner cylindrical surface of the tubular portion 20. Further, a compression seal 29 along with a support ring 30 described below, is sealingly clamped between the front end cap 22 and the tubular portion 20. The end caps 21,22 have a number of external bosses through which screws pass that are threaded into pads in the tubular portion 11. Two of the screws 31,31 for the rear end cap 21 are shown in FIG. 1, two of such screws 32,32 appear in FIG. 3, one of which is also shown in FIG. 2.

The handle 12 has an open hollow portion 33 which is molded integrally with the tubular portion 20 of the casing 11. A handle cap 34 has a grommet 35 for an electric cord (not shown), the cap 34 being secured by a number of screws 36 to the hollow open portion 33. The interior of the handle 12 is at atmospheric pressure, and appropriate wiring such as a cable 37 extends through a seal 38 in the wall of the tubular portion 20 to the electric motor 17.

The apertured heads 23 have a protrusion 39 which contains the apertures, and onto each of the protrusions 39, there is snapped a cap 40 which has an apertured central portion 41 spaced from the apertures of the head 39, and in this space, there is disposed an air filter medium 42.

The electric motor 17 is of the type that employs an armature 43 that coacts with a set of brushes 44,44 that have support means secured to the support ring 30. The armature has an output shaft 45 supported in one end by a bearing assembly 46 carried in a boss on the inner side of the front end cap 22, and the shaft 45 is supported intermediate its ends by a second bearing assembly 47 carried in a boss and held against a shoulder therein in a web 48 which is an integral part of the tubular portion 20 of the casing 11. The other apertures are air passages. The shaft 45 projects as a cantilever from the bearing assembly 47 and carries thereon eccentric means 49 which have two high-rise or maximum radius portions which are respectively disposed 180° out of phase with respect to each other. The eccentric means 49 is secured to the shaft 45 by a pair of set screws 50,51 arranged at right angles to each other. Normally, these set screws work against flat surfaces provided on the shaft 45. The eccentric means 49 drives the air compressor 16.

To operate the electric motor 17, a manually actuatable electric switch 52 is provided in the handle 12 in circuit with the motor 17. To control the switch 52, a trigger 53 is supported by a pivot 54 in the handle 12, there being a flexible finger 55 anchored near the pivot 54 but having an air space around its other three sides which is engagable with the actuator button of the switch 52. A guard 56 on the handle 12 prevents inadvertent operation of the trigger 53.

The pressurized portion 15 of the casing 11 has an outlet 57 for pressurized air that leads to openings such as 58,59, and also to a pressurizing passage 60 adjacent to the liquid intake port 14 for pressurizing liquid 61 in the container 19. A tube 62 opens below the surface of the liquid 61 and communicates fluidly with the fluid inlet port 14 for bringing liquid to a central opening that is normally closed by an axially slidable needle valve 63 which has a stem 64 that passes through a pressure seal 65 in the housing and thence through a part of the handle 12 just outside of the pressurized portion 15 of the casing. The stem 64 has a sleeve 66 pinned thereto intermediate its ends which provides oppositely facing shoulders 67,68. A threaded stop 69 has an axial bore that slidably receives and supports the end 70 of the stem 64, the inner end 71 of such bore serving as a stop or abutment for the end 70 of the stem 64, thus limiting the extent to which the needle valve 63 can be opened. A compression spring 72 acts between the stem 64 and the casing 11 to bias the needle valve 63 to a normally closed position, as illustrated. More specifically, the compression spring 72 acts between the shoulder 68 on the sleeve 66 and an end surface on the stop 69. The trigger 53 has a bifurcated upper end 73 which, when the trigger is moved, receives the stem 64 between its bifurcations enabling the trigger to engage the shoulder 67. Thus when the trigger is partially actuated, the finger 55 first actuates the electric switch 52 to start the motor 17 to pressurize the container 19 and to cause air to pass through the openings 58,59. Thereafter, the trigger 53 engages the shoulder 67 and slides the stem 64 of the needle valve 63 to the right to an extent limited by the space between the stem's end 70 and the stop surface 71. Trigger actuation stores energy in the spring 72. When the trigger 53 is partially released, the needle valve 63 is closed by a force from the spring 72, well before the switch 52 is deactuated, thus providing a few moments of continued air pressurization after the flow of liquid has been stopped. As the flexible finger 55 is integral with the trigger 53 at the pivot 54, the arrangement enables the over-travel of the trigger 53 to open the needle valve 63 after the switch 52 is actuated as well as the preliminary closing travel of the stem when the trigger is released before the switch 52 is deactuated.

The air compressor 16 has air inlet means, here in the form of a wall of the casing 11 having a set of apertures 74 arranged in a first pattern in the heads 23. The compressor 16 has an outlet which here comprises the pressurizable chamber 15 leading to the outlet passage 57. The eccentric means 49 reciprocates connecting rod means, here comprising a pair of simultaneously acting connecting rods 75,76. A pair of bearing assemblies 77,78 each has an inner race that is carried on one of the drive portions of the eccentric means 49 and an outer race to which the connecting rods 75,76 are clamped. The parts (described below) which the connecting rods 75,76 drive are generally oval-shaped in a longitudinal direction of the gun 10. Each connecting rod 75,76 has a split-ring portion 79 (FIG. 2) which encircles the outer race of the respective bearing by an amount exceeding 180° but less than 360°. A rod portion extends from each of the ends of such split ring 79 to approximately the focuses of the oval structure that it drives. Thus, one of the spaced legs or portions 80 is shown nearer the viewer in FIG. 2 and has been cut away to show in elevation the other leg or portion 81, there being a clamping screw 82 which draws the leg portions 80,81 toward each other and thus clamps the split ring 79 tightly about the outer race of the bearing 77,78. The split ring 79, the leg portions 80,81 and the structure about to be described to which they are secured comprise an integrally molded unitary piece also referred to below as a driven plate.

The air compressor 16 has a pair of pressure chambers such as 83 (FIGS. 2 and 5), the volume of which increases and decreases in response to reciprocation of the connecting rods 75,76. An inlet clock valve 84 communicates the wall openings 74 with the pressure chamber 83 whenever the volume of the chamber 83 increases. An outlet check valve 85 communicates the pressure chamber 83 with the pressurized portion 15 whenever the volume of the pressure chamber 83 decreases.

Each inlet check valve 84 is formed as a part of the heads 23 respectively and to that end includes a smooth wall surface 86 on the inside of the casing head 23, a plate 87 secured in spaced relation to the smooth surface 86 and having a series or pattern of apertures 88 arranged therein in a second pattern which is out of register with the pattern of the apertures 74. Further, a diaphragm 89 is peripherally clamped between the plate 87 and a portion of the head 23 that surrounds the first pattern of apertures 74. The diaphragm 89 also is apertured and its pattern of apertures is arranged to be the same as that of the second pattern in which the apertures 88 are arranged. The central apertured portion of the diaphragm 89 is movable to engage the smooth surface 86 or to engage a smooth face 90 on the plate 87. During a compression stroke illustrated in FIG. 5, pressure in the pressure chamber 83 acts on the left side of the diaphragm 89 and seats it against the smooth surface 86 to close all the apertures 74. During a return stroke shown in FIG. 6, a slight negative pressure in the pressure chamber 83 causes atmospheric pressure to enter the apertures 74 to unseat the diaphragm 89, thereby enabling air to move under the influence of atmospheric pressure into the pressure chamber 83.

The outlet check valve 85 is built into the movable wall of the pressure chamber 83 and to that end includes a chamber plate 91 having a set of apertures 92 leading through a smooth surface 93. The chamber plate 91 is secured at its periphery to a driven plate 94 spaced from the smooth surface 93 and having a set of apertures 95 therethrough. The apertures 95 are arranged in a first pattern which may be the same as the first pattern for the apertures 74, and they are out of register with the apertures 92 which are arranged in a second pattern, which may be the same as the second pattern for the apertures 84. The driven plate 94 is the one that is here disclosed as being integral with the connecting rod means 75, etc. A diaphragm 96 is in the space between the chamber plate 91 and the driven plate 94 and is movable therebetween for engagement with the smooth surface 93 to close all of the apertures 92, the diaphragm 96 having a set of apertures 97 which are arranged in a pattern which is the same as that of the apertures 95.

As best seen in FIG. 4, the cap 40, the protrusion 39, the head 23, the flange 24, the diaphragms 89, 96, the various patterns of apertures, the inlet check valve plate 87, the chamber plate 91 and the driven plate 94 are all oval shaped. In this embodiment, the oval diaphragm 96 has a central portion that lies within the space between the chamber plate 91 and the driven plate 94 and this portion functions as the movable part of the outlet check valve 85. The diaphragm 96 also has a movable portion surrounding the plates 91,94 which provides a peripheral seal between the apertured plate 87 on the casing and the movable reciprocable wall of the pressure chamber 83. The outer periphery of the diaphragm 96 is sealingly clamped between the head 23 and the flange 24 by a series of screws 98 which extend through the periphery of the head 23 and into a series of knurled metal inserts 99 molded into the flanges 24, 25. Thus, the oval diaphragm 96 functions to provide both part of the movable wall of the pressure chamber 83 as well as the movable portion of the outlet check valve 85.

When the device is constructed to a size just slightly larger than the scale shown in the patent drawing, it has a theoretical displacement of 2.16 cubic inches with a stroke of 0.20 inch. It has a theoretical delivery rate at sea level pressure and at a motor speed of 7500 rpm of 9.375 cubic feet per minute. Thus, a required delivery rate of 6 cubic feet per minute at 3 psi can be obtained. It is estimated that the power needed to drive the spray gun in one-sixth horsepower.

Although many minor modifications might be suggested by those versed in the art, it should be understood that all such embodiments as reasonably and properly come within the scope of the contribution to the art is embodied within the scope of the patent warranted hereon.

What is claimed is:

1. A spray gun for compressed-air spraying of liquids, comprising:

(a) a casing having a handle near one end, and a nozzle at its opposite end communicating with a liquid intake port on said casing;

(b) an electric motor disposed within and supported by said casing;

(c) an air compressor disposed within said casing, an apertured wall of said casing being air inlet means of said compressor, said compressor having an outlet communicating with said nozzle, and said compressor being drivably connected to said electric motor, said compressor including (1) means defining a pressure chamber including a movable wall reciprocally driven by said motor whose volume is increased and decreased in response to operation of said electric motor;

(2) an inlet check valve communicating said apertured casing wall with said chamber in response to a volume increase; and (3) an outlet check valve combined in said movable wall and communicating said chamber with said outlet in response to a volume decrease, said combined movable wall and outlet check valve comprising ((a)) a chamber plate facing said pressure chamber, and having a smooth surface directed away from said chamber;

((b)) a driven plate secured peripherally to said chamber plate and having a face confronting said smooth surface and spaced therefrom, said driven plate being connected to said motor, said driven plate having a set of apertures therethrough arranged in a first pattern;

((c)) said chamber plate having a set of apertures therethrough arranged in a second pattern out of register with said first pattern; and ((d)) a diaphragm clamped and sealed peripherally to said casing and defining a wall of said pressure chamber, said diaphragm having a set of apertures therethrough registering with said first pattern, a central portion of said diaphragm being disposed in the space between said chamber plate and said driven plate and clamped thereby along a portion surrounding said first pattern, said central portion being movable against said smooth surface to close all the apertures of said second pattern in response to an air pressure at said outlet in excess of the pressure in said pressure chamber; and (d) a liquid container detachably secured to said casing at and in fluid communication with said liquid intake port, there being an air passage from said compressor outlet into said liquid container for pressurizing liquid therein.

2. A spray gun for compressed-air spraying of liquids, comprising:

(a) a casing having a handle near one end, and a nozzle at its opposite end communicating with a liquid intake port on said casing;

(b) an electric motor disposed within and supported by said casing;

(c) an air compressor disposed within said casing, an apertured lateral wall of said casing adjacent to said handle being air inlet means of said compressor, said compressor having an outlet communicating with said nozzle, and said compressor being drivably connected to said electric motor;

(d) said electric motor being disposed in a pressurizable portion of said casing;

(e) said handle being hollow and vented to the atmosphere, and sealed from said pressurizable portion;

(f) a manually actuatable electric switch in said handle;

(g) electric wiring extending from said switch, through a pressure seal in the wall of said casing, and to said electric motor; and (h) a liquid container detachably secured to said casing at and in fluid communication with said liquid intake port, there being an air passage from said compressor outlet into said liquid container for pressurizing liquid therein.

3. A spray gun according to claim 2:

(a) said nozzle including a movable needle valve having a straight stem extending through a seal in a wall of said pressurizable portion of said casing, and through said handle and slidably supported by said handle;

(b) said stem having an enlarged fixed shoulder formed as a sleeve with oppositely facing sides;

(c) a compression spring within said handle and acting between said handle and one side of said shoulder; and (d) a trigger pivoted at a lower end on said handle and including a flexible finger integral with said trigger at said lower end engageable with said switch, and said trigger having a bifurcated distal upper end receiving said stem and engageably with an oppositely facing side of said shoulder after said finger has engaged and closed said switch.

4. A spray gun for compressed-air spraying of liquids, comprising:

(a) a casing having (1) a tubular body portion having an apertured web disposed centrally therein, at least one lateral side opening surrounded by a flange, an open hollow handle portion extending generally radially therefrom, and a pressure seal leading through said body portion into said handle portion, (2) a rear end cap secured to and sealing an end of said tubular body portion, (3) a front end cap secured to and sealing the other end of said tubular body portion, said front end cap having a portion supporting a nozzle and having a liquid intake port, (4) an apertured head secured to said flange, and (5) a handle-cap secured to and closing said open handle portion;

(b) an electric motor having a rotatably armature supported at one end by said front end cap and at its opposite end by said apertured web, with electric leads passing therefrom through said pressure seal;

(c) an air compressor disposed within said casing, said apertured head being air inlet means of said compressor, said compressor having an outlet communicating with said nozzle, and said compressor being drivably connected to said electric motor; and (d) a liquid container detachably secured to said front end cap at and in fluid communication with said liquid intake port, there being an air passage from said compressor outlet into said liquid container for pressurizing liquid therein.

5. A spray gun according to claim 4, said apertured head having a protrusion in which the apertures are disposed, a cap covering said protrusion and having a central apertured portion disposed in spaced relation to said head apertures, and an air filter medium filling such space.

6. A spray gun according to claim 4, including:

(a) a set of brushes coactive with a commutator of said armature; and (b) brush support means including a support ring clamped by said front end cap to said tubular body portion.

7. A spray gun according to claim 4, said rotatable armature having an output shaft, said air compressor including a pair of connecting rods extending radially from said armature shaft, and a pair of eccentrics interconnecting said connecting rods to said shaft, the maximum radii of said eccentrics extending radially from the axis of said shaft and being disposed 180 degrees apart.

8. A spray gun for compressed-air spraying of liquids, comprising:

(a) a casing having a handle near one end, and a nozzle at its opposite end communicating with a liquid intake port on said casing, said casing having an opening closed by a separate apertured plate;

(b) an electric motor disposed within and supported by said casing;

(c) an inlet check valve carried by said apertured plate for cooperation with the apertures thereof;

(d) a flexible movable wall facing said check valve and said plate, said movable wall being connected to said motor and adapted to be reciprocated by it toward and away from said wall;

(e) a pressure seal acting between the peripheries of said apertured plate and said movable wall, whereby said apertured plate and said movable wall jointly define a pressure chamber within said casing whose volume is increased and decreased in response to operation of said motor;

(f) an outlet check valve communicating said chamber with said nozzle; and (g) a liquid container detachably secured to said casing at and in fluid communication with said liquid intake port, there being an air passage from said outlet check valve into said liquid container for pressurizing liquid therein.

9. A spray gun according to claim 8, said flexible movable wall having said outlet check valve disposed therein.

10. A spray gun according to claim 9, including a one-piece diaphragm forming part of said movable wall and forming also a movable valve element of said outlet check valve.

11. A spray gun for compressed-air spraying of liquids, comprising:

(a) a casing having a handle near on end, and a nozzle at its opposite end communicating with a liquid intake port on said casing;

(b) an electric motor disposed within and supported by said casing;

(c) an air compressor disposed within said casing and drivably connected to said motor, and having means defining a pair of pressure chambers whose volumes are increased and decreased in phase with each other in response to operation of said electric motor;

(d) a pair of inlet check valves respectively communicating separate apertured wall portions of said casing with said chambers in response to the in-phase volume increases;

(e) a pair of outlet check valves respectively communicating said chambers with said nozzle in response to the in-phase volume decreases; and (f) a liquid container detachably secured to said casing at and in fluid communication with said liquid intake port, there being an air passage from said outlet check valves into said liquid container for pressurizing liquid therein.

12. A spray gun for compressed-air spraying of liquids comprising:

(a) a casing having a handle near one end, and a nozzle at its opposite end communicating with a liquid intake port on said casing;

(b) an electric motor disposed within and supported by said casing;

(c) an air compressor disposed within said casing, an apertured wall of said casing being air inlet means of said compressor, said compressor having an outlet communicating with said nozzle, and said compressor being drivably connected to said electric motor;

(d) said electric motor being disposed in a pressurizable portion of said casing;

(e) said handle being hollow and vented to the atmosphre, and sealed from said pressurizable portion;

(f) a manually actuatable electric switch in said handle;

(g) electric wiring extending from said switch, through a pressure seal in the wall of said casing, and to said electric motor;

(h) a liquid container detachably secured to said casing at and in fluid communication with said liquid intake port, there being an air passage from said compressor outlet into said liquid container for pressurizing liquid therein;

(i) said nozzle including a movable needle valve having a straight stem extending through a seal in a wall of said pressurizable portion of said casing, and through said handle and slidably supported by said handle;

(j) said stem having an enlarged fixed shoulder formed as a sleeve with oppositely facing sides;

(k) a compression spring within said handle and acting between said handle and one side of said shoulder;

(l) a trigger pivoted through a flexible finger on said handle and having a bifurcated distal end receiving said stem and engageably with an oppositely facing side of said shoulder after said trigger has engaged and closed said switch; and (m) a thumbscrew threaded into said casing, and having an axial bore directly slidably supporting an end portion of said stem, the inner end of said bore being an abutment for the end of said stem.

13. A spray gun for compressed-air spraying of liquids, comprising:

(a) a casing having a handle near one end, and a spray nozzle at its opposite end communicating with a liquid intake port on said casing;

(b) an electric motor disposed within and supported by said casing;

(c) an air compressor disposed within said casing, a pair of oppositely facing apertured lateral walls of said casing being air inlet means of said compressor, said compressor having a pair of oppositely facing outlets discharging into the interior of said casing and communicating with said spray nozzle, and said compressor being drivably connected to said electric motor;

(d) said motor being disposed in a pressurizable portion of said casing in the path in which compressed air flows from said compressor outlets to said spray nozzle; and (e) a liquid container detachably secured to said casing at and in fluid communication with said liquid intake port, there being an air passage from said compressor outlet into said liquid container for pressurizing liquid therein.

* * * * *